United States Patent [19]

Schriber et al.

[11] 4,129,293

[45] Dec. 12, 1978

[54] COLLATING MACHINE WITH LARGE ROLL SUPPLY

[75] Inventors: Louis Schriber; Robert E. Stephens, both of Dayton, Ohio

[73] Assignee: Harris Corporation, Cleveland, Ohio

[21] Appl. No.: 605,903

[22] Filed: Aug. 19, 1975

[51] Int. Cl.[2] ..... B65H 39/00

[52] U.S. Cl. ..... 270/52

[58] Field of Search ..... 270/10, 11, 30, 31, 270/40, 41, 43, 52; 242/79; 214/500

[56] References Cited

U.S. PATENT DOCUMENTS

| | | | |
|---|---|---|---|
| 2,734,405 | 2/1956 | Cozzo | 242/79 |
| 3,160,409 | 12/1964 | Lucas | 270/41 |
| 3,424,394 | 1/1969 | Moore | 242/79 |
| 3,567,211 | 3/1971 | Martin | 270/31 |
| 3,682,468 | 8/1972 | Schriber | 270/52 |

*Primary Examiner*—Edgar S. Burr
*Assistant Examiner*—A. Heinz
*Attorney, Agent, or Firm*—Biebel, French & Nauman

[57] ABSTRACT

A collator for assembling continuous business forms or the like has arbors supported in spaced cantilever fashion over a platform, and can be moved by fluid motors between a loading position where rolls are mounted from the platform onto the arbors, and a raised supply position from which web material is unwound from the roll. Each arbor is manually adjustable in the loading position to align the roll core and the arbor so that the roll can be quickly mounted. A dolly is provided on the platform near each arbor to transport rolls in a horizontal direction to and onto the arbor. A counterbalance offsets the weight of the arbor and its support to ease manual alignment of the arbor shaft with the core of a new roll. Ramps extend from the platform to the floor, allowing large heavy rolls to be rolled onto the dollies.

5 Claims, 7 Drawing Figures

COLLATING MACHINE WITH LARGE ROLL SUPPLY

BACKGROUND OF THE INVENTION

This invention relates particularly to machines for collating webs of flexible paper material.

Such machines are employed for assembling a plurality of webs of flexible material, fastening the webs together along marginal edge portions. Usually the webs are preprinted paper forms and interleaved carbon paper webs which together construct continuous severable sets of business forms. Rolls of carbon (where used) and preprinted paper are mounted on horizontal arbors and the end of each roll is fed around a series of idler rods and tension bars to a main feed cylinder or cylinders where the webs are collected. Examples of such collators are U.S. Pat. Nos. 3,303,083 and No. 3,682,468.

An increasing demand for business forms, coupled with general rising costs of doing business, has resulted in a need for a collating machine which is economical in both cost and operation. The number of forms produced per unit time is a factor in operating costs, and so to reduce the operating costs, the machine should perform with minimum down time, for example, by reducing time for loading the paper and for carbon webs in the machine.

A machine capable of handling large rolls of webs is more economical to operate in that it can require less down time to replace the rolls, but use of larger rolls generally requires separate feeding mechanism, as well as equipment to lift and load the heavier larger rolls, all of which add to manufacturing expense. Conversely, a compact machine which handles relatively small feed rolls can be relatively less expensive to build, but requires frequent roll changes and the consequential down time can result in high operating costs. On the other hand, the size and weight of larger rolls is such that they cannot be lifted or moved without mechanical assistance, and in general lifting and transporting mechanisms tend to be complicated and expensive.

While devices are known for handling heavy coils or rolls of material, such as aluminum and steel strip, or for use in rewinding or slitting larger rolls of material, their use in a collating machine to handle larger paper rolls would make the cost of the collating machine prohibitive both in terms of initial cost and operating cost. For example, U.S. Pat. Nos. 3,077,317 and No. 3,345,014 disclose cart-like devices movable in a horizontal plane and having a hydraulic elevator incorporated therein, which lift a heavy coil from a mandrel on which the coil is wound and transport the coil away from the mandrel. Such elevator carts might appear to be useful to move a roll of paper toward a supply arbor on a collator, but such a device and its necessary support equipment would greatly increase the cost of the collator.

Accurate alignment is important when working with the larger heavier rolls, where the most convenient supply arbor is a cantilever type, and the roll must be slid or moved horizontally onto the arbor. The alignment between the mandrel or arbor and the opening in the roll core must be such that friction is minimized during sliding the roll on the arbor. Core damage may cause even greater effort and time in pushing the roll onto the arbor, but if the apparatus has some means for quickly making fine adjustments in the axial alignment of the arbor and/or the roll, time loss can be minimized.

SUMMARY OF THE INVENTION

The present invention provides an improved means for supporting supply rolls in a collator for assembling continuous business forms or the like.

The supply spindles or arbors are supported in spaced cantilever fashion, and can be pivoted, by fluid motors between a loading position where a roll is mounted on the arbor and a supply or running position wherein the web is unwound from the roll. Each arbor is manually adjustable in the loading position to align the roll core and the arbor so that the roll can be quickly mounted. Preferably a simple cart or dolly is provided near each arbor to transport rolls in a horizontal direction to and onto the arbor. Once the roll is loaded from the cart onto the arbor, the fluid motor can move the arbor and roll into the supply position.

The use of a counterbalance which offsets the weight of the arbor and its support, in combination with a predetermined amount of movement or flexibility or play in the fluid motor means and its connection to the arbor shaft pivoting mechanism, provides enough manual adjustability of the arbor shaft to align it quickly with the core of a new roll. This combination provides a basically simple and inexpensive, yet effective, device which allows new rolls to be quickly loaded.

In order to load a set of rolls onto the arbors, the rolls are moved into a ready position on carts located in the platform of the supply apparatus. The heavy rolls (as much as 750 pounds each) can easily be rolled up ramps onto the platform, and along it onto the dollies. When ready to load, the rolls can be transported horizontally adjacent to the arbors, using the carts or dollies, and the arbors are lowered and aligned by manually moving the horizontally extending arbor shafts slightly up or down until alignment is achieved. Then the roll is simply slid onto the arbor. The weight of the roll is carried primarily by the dolly, and not by the arbor shaft, as the core is slid onto the arbor. Use of the dollies allows the rolls simply to be pushed onto the arbor. As a result the operator's as well as machine down time are not wasted.

It is therefore an object of the present invention to provide an improved and simplified apparatus for loading, supporting and unwinding rolls of web material in a collating machine, incorporating the above described features.

Other objects and advantages of the invention will be apparent from the following description, the accompanying drawings and the appended claims.

DETAILED DESCRIPTION OF THE INVENTION

Figure 1:
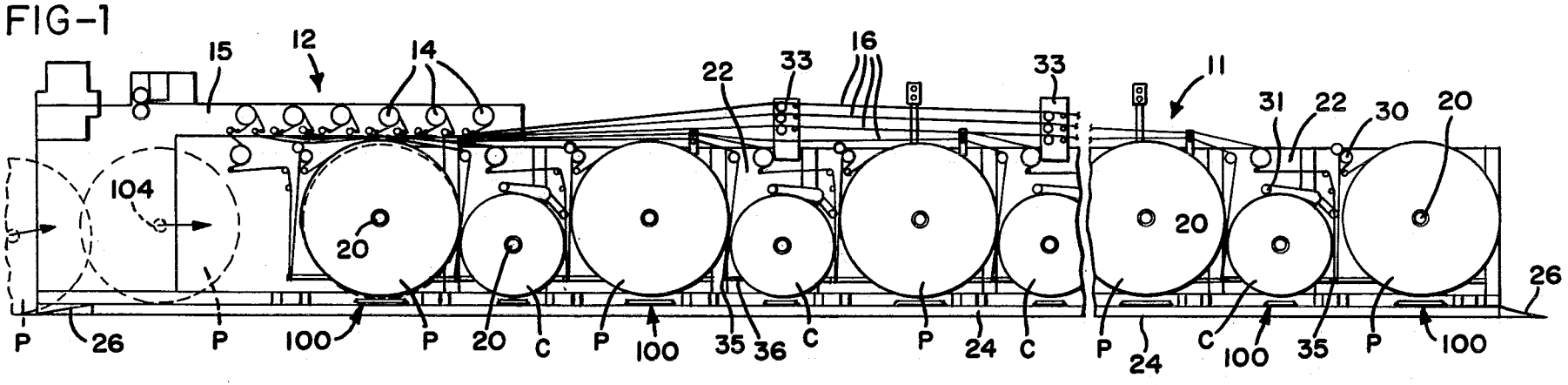
FIG. 1 is a somewhat schematic elevational view of a collator incorporating the improved web feeding and unwinding apparatus of the invention.

FIG. 1 shows generally a collating apparatus which includes a web feeding section 11 and a collating section 12. The collating section 12 employed is conventional and basically comprises a plurality of pin cylinders 14 acting in conjunction with a table 15 to assemble a plurality of paper webs 16, fed from the web feeding section 11. The webs 16 have longitudinally spaced marginal perforations, with which the webs are brought into an overlapping registered relationship for subsequent attachment and (in some cases) folding steps to make business forms or the like. The paper webs are preprinted forms, and are interleaved with carbon paper webs, each fed from appropriate rolls which are indicated P and C, respectively. Examples of collating apparatus which could be employed in collating section 12 are shown in U.S. Pat. No. 3,303,083 and No. 3,682,468.

The feed section 11 incorporates a plurality of spaced horizontal spindles or arbors 20 supporting the rolls for free rotation. The arbors 20 are supported, in turn, on a vertical frame 22 extending upward from a horizontal platform 24 which supports the frame and also provides a work surface from which the arbors 20 can be loaded.

Each web is unwound from the rolls by a drive means 30 or 31, respectively, and guided to the collating section 12 by a series of guide towers 33. The drives 30 and 31 normally will cause the webs 16 to feed to the collating section 12 at a slightly higher rate than is necessary in order to prevent tearing of the spaced marginal perforations or feed holes.

Figure 4:
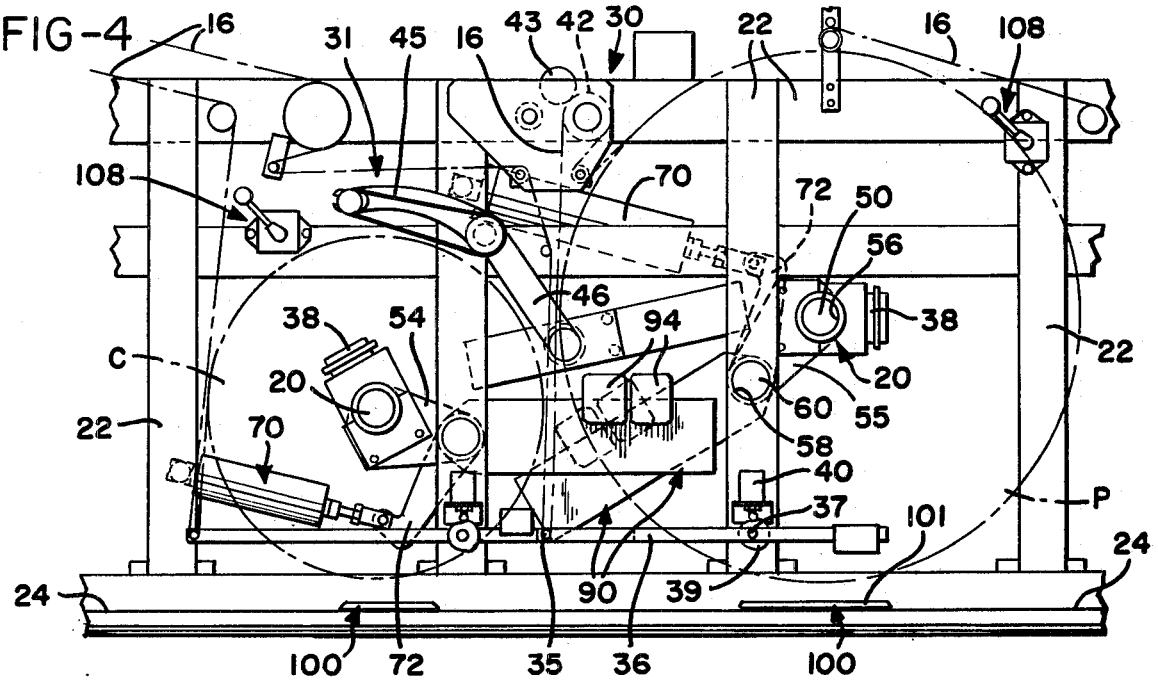
FIG. 4 is an enlarged partial side view showing two rolls and arbors in the supply position.

The webs are directed from their respective rolls around dancer rods 35 which extend outward from counter-balanced arms 36 having pivot mounts 37 (FIG. 4). Since arbors 20 are supported for free rotation, pneumatic brakes 38, which are appropriately supported in fixed relation to the arbor supports, are associated with each arbor to control the rate of unwind of the webs 16 and prevent excessive overrun. Attached to each counterbalanced arm 36 at the pivot 37 is a cam 39 which rotates in response to movement of dancer rod 35. Regulator 40, sensing the cam movement, signals the corresponding brake 38 and regulates the application of the brake 38. Thus, when the tension of a particular web 16 begins to drop below a predetermined level, the corresponding dancer rod 35 moves downwardly and causes the corresponding brake 38 to apply pressure against rotation of the corresponding arbor 20.

As shown in FIG. 4, the drive 30 for rolls P comprises a driven pull roll 42 (the drive is not shown) and which operates in conjunction with a gripper wheel 43 holding the web against the pull roll. The carbon roll (c), drive means 31 employs an endless belt 45 supported by a pivoted frame 46 to contact the periphery of roll c. The belt is driven through one of its supporting rollers by a suitable drive (not shown). The particular drives employed for rolls are not critical, but the drives shown are exemplary.

Regardless of the type of drive employed, a means is provided which causes the particular drive to slip to a limited extent when brake 38 is applied to arbor 20, in order to provide an essentially constant feed of the web 16 depending upon the demand from the collating section 12.

Each arbor 20 comprises a shaft 50 rotatably supported at one end thereof in an arbor support 52. The exterior surface of the arbor shaft preferably will have one or more flats thereon, to enable the arbor to accept rolls having a slightly damaged cores. The outer end 54 of shafts 50 has a blunt or bullet like shape to aid in guiding the roll cores onto the arbor.

Figure 3:
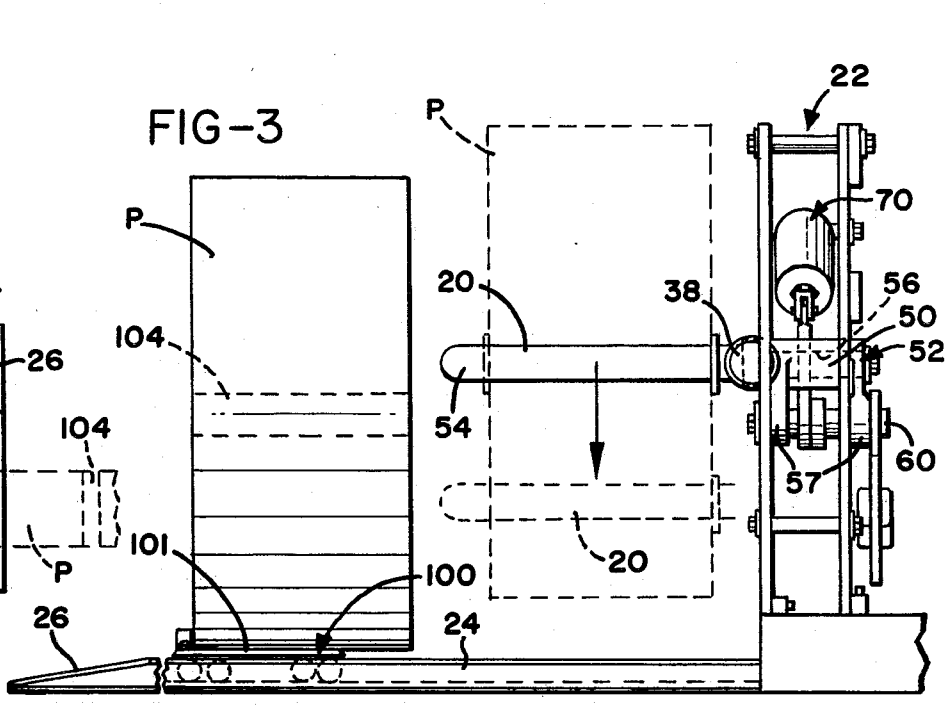
FIG. 3 is an end view of the web feeding section.

The arbor support arm comprises a casting 55 having a through bore 56 in which arbor shaft 50 is supported in cantilever fashion. The arms 57 of the casting (FIG. 3) have openings 58 in the ends thereof through which support shaft 60 passes. Arbor support 52 is keyed to shaft 60 so that arbor 20 will pivot about shaft 60.

Figure 5:
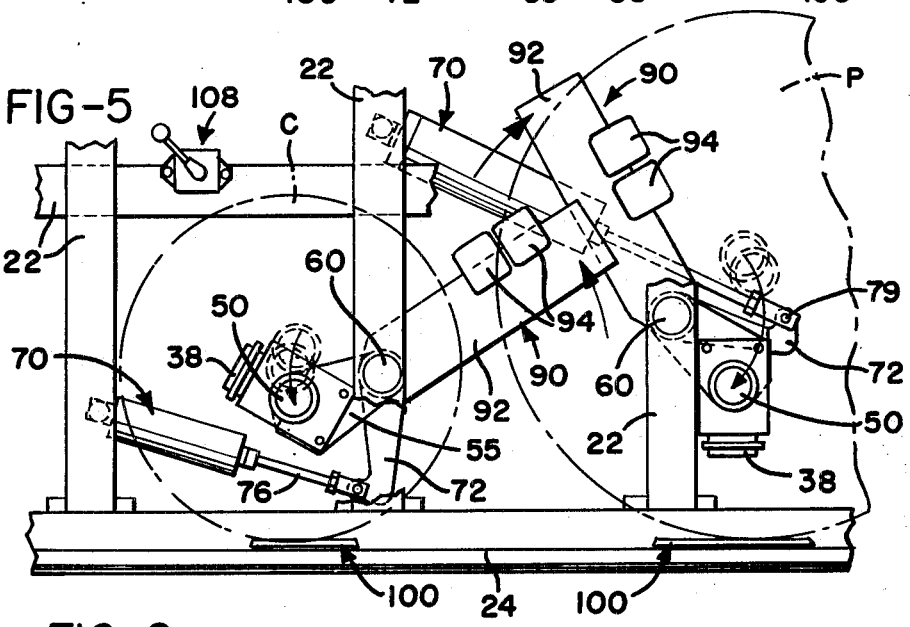
FIG. 5 is a view similar to FIG. 4 showing the two rolls and arbors in the loading position.

Shaft 60 is supported for rotation in appropriate bearings (not shown) mounted in frame 22. Thus, arbor 20 can be pivoted between a high or supply position (shown in solid lines in FIG. 3), in which the web 16 will unwind and be fed to the collating section 12, and a lower or loading position (shown by dotted lines in FIG. 3). At the loading position there are a range of lower positions through which the arbor 20 is infinitely variable, since the apparatus is capable of handling a wide variety of sizes or rolls, and thus will have a lowermost position beyond that necessary for a larger roll. The supply and loading positions are also shown in FIGS. 4 and 5, respectively.

Figure 7:
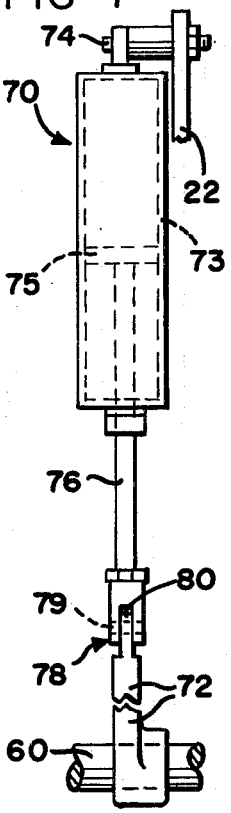
FIG. 7 is an enlarged view of the hydraulic motor lift employed to move the arbors.

The arbor 20 and arbor support means 54 are pivoted by the use of a pneumatic lifting motor or cylinder 70 which is connected to shaft 60 by crank arm 72, which is keyed to shaft 60. As shown in FIG. 7, the fluid motor means 70 comprises a cylinder 73 pivotally connected at 74 to frame 22. Piston 75 is connected to rod 76 which, in turn, is connected to crank arm 72 by a clevis 78 and a connecting pin 79 which passes through an opening 80 in one end of arm 72. The clevis 78 is threaded onto piston rod 76. The sizes of pin 79 and opening 80 are not critical, although it is desirable that there be some variance between the size of opening 80 and pin 79, e.g., about ¼ inch. Thus, between the flexibility of the clevis connection and the inherent spring-like action of the pneumatic motor, due to the compressibility of the air on either side of piston 75, a predetermined flexibility or play will exist in the drive for moving the arbor.

To provide manual adjustability for arbor 20 once it has been swung into the loading position by motor 70, the flexibility of the linkage and the pneumatic cylinder, as discussed above, is employed in combination with a counter-balance means 90 which offsets the weight of the arbor 20 and arbor support 54. The counterbalance means 90 comprises an arm 92 fixed to shaft 60 and on which weights 94 are affixed at an appropriate distance from shaft 60. The counterbalance means 90 neutralizes the weight of the arbor support casting 54 and arbor 20 and allows the arbor to be moved to the extent permitted by the predetermined amount of play in the linkage and the pneumatic cylinder.

Figure 6:
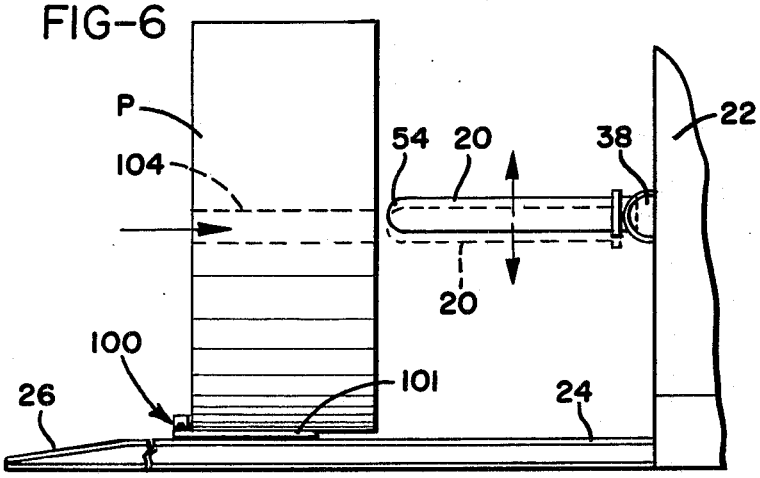
FIG. 6 is a view similar to FIG. 3 showing adjustments during the loading of a roll.

While the motion of arbor 20 describes an arc due to its fixed relationship to shaft 60, in the loading position the major motion is essentially vertical, and this manually induced vertical movement allows the arbor to be adjusted and aligned with the opening in the core of a roll, as is shown in FIG. 6.

As can be appreciaated, the present invention provides an improved means for supporting a supply roll of a continuous web, and for quickly and efficiently loading the same. The mechanism is simple and uncomplicated, and will not add appreciably to the operating cost of the collator.

Figure 2:
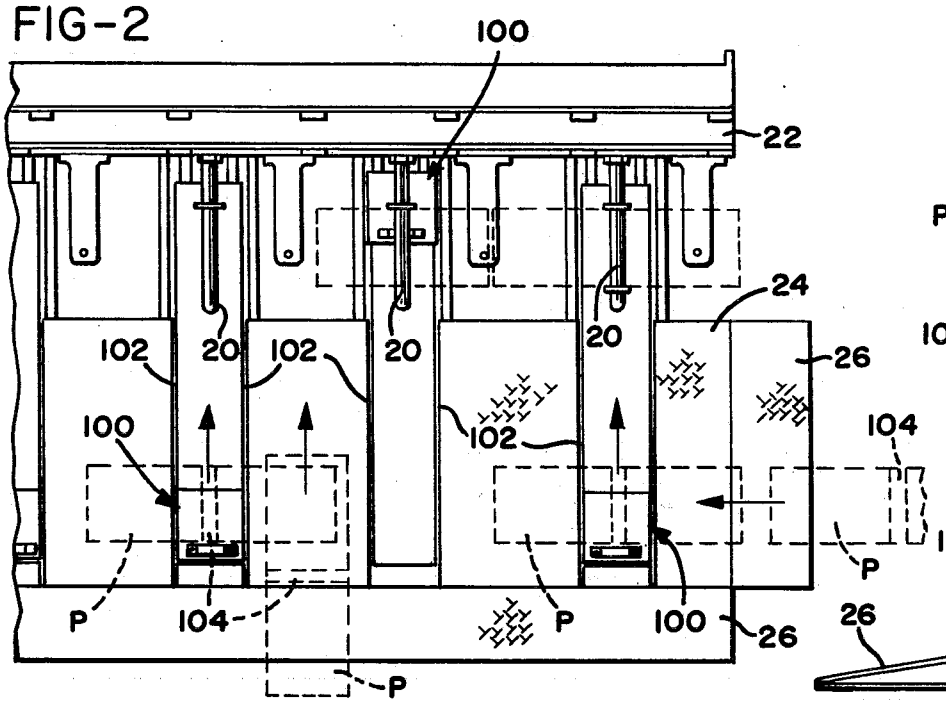
FIG. 2 is a top view of the right hand end of the apparatus shown in FIG. 1.

Preferably, the adjustable arbors are to be used in association with simple carts or dollies 100. The dollies are simple wheeled platforms which operate in tracks 102 in platform 24, and can be stored underneath the arbors in the feeding section 12 when not in use (see FIG. 2). Each dolly has a platform 101 which is generally at the level of (or slightly above) the main platform 24.

As shown in FIG. 6, to load one of the arbors 20, a roll P (for example) is placed on a cart 100 simply by rolling the relatively heavy roll up one of the ramps 26 and onto the cart 100, and pivoting the roll about its vertical axis until the core 104 of the roll is oriented with the arbor 20. The roll is far enough from the arbor shaft that the core of a depleted roll can be withdrawn, even though a roll is already on a cart in a "ready" position. Next, the roll and cart are moved horizontally until the roll P is adjacent the arbor 20. Meanwhile, the arbor 20 can be pivoted into approximate loading position using the fluid motor means 70 which can be controlled by a pneumatic control valve 108 (FIG. 4) located in close proximity to the arbor 20. The operator can then manually align the arbor 20 and the core or opening 104 in the roll P and slide the roll onto the arbor, with the cart 100 bearing the major weight of the roll. The blunt nose 54 of the arbor will aid in guiding the roll on the arbor as well as aligning the core 104 and the arbor 20, the action being self-centering due to the ability of the arbor to move slightly, as previously explained.

It will be appreciated that a full set of rolls (P & C) can be readied on the carts 100 while the collator is operating. When the rolls in use are depleted, their cores can easily be removed from the arbor shafts, the arbors loaded, and the new rolls quickly loaded and moved to the supply positions so the threading of the webs can quickly begin.

While the forms of apparatus herein disclosed constitute preferred embodiments of the invention, it is to be understood that the invention is not limited to these precise forms of apparatus, and that changes may be made therein without departing from the scope of the invention.

What is claimed is:

1. In a collating machine for assembling a plurality of rolls of pre-printed web material into overlapping registered relationship, including a machine frame and plural rotatable arbor shafts for supporting the rolls spaced apart in cantilever fashion, and means for withdrawing the web material from each of said rolls and combining the webs as a multi-layer unit, the improvement comprising:

a roll supporting work surface extending to one side of said frame beneath said arbor shafts and arranged to permit rolling of heavy full rolls into loading position on said work surface, a plurality of support arms each rotatably carrying one of said arbor shafts and each pivoted on said frame for moving said arbor shafts between a lower loading position wherein rolls can be pushed from said working surface onto said arbor shafts and a supply position raised above said surface at which the web material can be unwound from the rolls, independently operable motor means connected to move each said support arms between the loading and supply positions, and roll carrying dollies movably mounted on said surface to transport rolls onto those arbor shafts located in loading position and supporting the weight of the rolls until the rolls are fully mounted onto said arbor shafts.

2. In a collating machine for assembling a plurality of rolls or pre-printed web material into overlapping registered relationship, including a machine frame and plural arbors for supporting the rolls in spaced relation, the improvement comprising:

(a) arbor shafts for supporting the rolls, said shafts having a free end and a supporting end, (b) a roll supporting platform, said platform extending sideways laterally of said frame beyond the free ends of said arbor shafts sufficiently to support rolls in a ready position outwardly of said arbor shafts from which the rolls can be moved sideways toward said frame onto said arbor shafts with said shafts moved to the loading position, (c) arbor support means rotatably connected to said supporting ends of said arbor shafts holding said shafts in parallel cantilever fashion over said platform whereby the rolls can be loaded over said free ends of said shafts from said platform, (d) said arbor support means including a plurality of independent mechanisms each movably connected to said machine frame, (e) independently operable motor means incorporated in each of said mechanism to move said arbor shafts between a lower loading position wherein rolls of web material can be loaded from said platform onto said arbor shafts and a supply position raised above said platform wherein webs can be unwound from the rolls, (f) one ramp extending from said platform providing a means over which full rolls can be rolled into preloading position on said platform adjacent to said arbors, and (g) dollies movably mounted on said platform in lateral alignment with said arbors to receive the rolls in the preloading position and to carry the rolls into engagement with the arbor shafts lowered into loading position.

3. A collating machine as defined in claim 2, wherein said arbor shafts are slightly movable independently of said motor means to align said arbor shafts with full rolls supported on said platform.

4. In a collating machine for assembling a plurality of large heavy rolls of pre-printed web material into overlapping registered relationship, including a machine frame having a base and plural stations for supporting the rolls in spaced aligned relation along said frame, the improvement comprising:

(a) arbor shafts at each of said stations for supporting the rolls, each said shaft having a free end and a supporting end, (b) a roll supporting loading platform extending along one side of said frame, (c) arbor support means rotatably supporting said arbor shafts from said supporting ends extending in parallel cantilever fashion to said one side of said frame whereby the rolls can be loaded thereon from said platform to unwind for feeding into collated relationship, (d) said arbor support means including a plurality of independent mechanisms on said machine frame each supporting one of said arbor shafts for movement between a lower loading position wherein rolls of web material can be pushed across said platform onto said arbor shafts over said free ends thereof and a supply position raised above said platform at which the webs can be unwound from the rolls, (e) independently operable motor means operatively connected to each of said mechanisms to move said arbor shafts between the loading and supply positions, (f) said platform extending laterally of said frame beyond said free ends of said arbor shafts sufficiently to support rolls in a ready position from which the rolls can be moved directly sideways onto said arbor shafts when said shafts are moved to said loading position, and (g) a plurality of loading dollies, one for each arbor, supported on said platform for movement toward and away from said frame beneath and outwardly of the associated arbor shafts, said dollies having roll supporting surfaces close to said platform to allow the rolls to be rolled onto said dollies.

5. A collating machine as defined in claim 4 wherein said platform is raised above said base and is provided with at least one loading ramp extending therefrom to the floor on which said base is placed to provide for rolling of the heavy rolls onto said platform and into the ready position.

* * * * *